US006408670B1

(12) United States Patent
Trapp

(10) Patent No.: US 6,408,670 B1
(45) Date of Patent: Jun. 25, 2002

(54) CARRIERLESS PROGRESSIVE DIE SYSTEM

(76) Inventor: George Trapp, 42993 Ashbury Dr., Novi, MI (US) 48375

( * ) Notice: Subject to any disclaimer, the term of this patent is extended or adjusted under 35 U.S.C. 154(b) by 0 days.

(21) Appl. No.: 09/648,931

(22) Filed: Aug. 25, 2000

Related U.S. Application Data

(60) Provisional application No. 60/150,648, filed on Aug. 25, 1999.

(51) Int. Cl.[7] ..... B21D 28/06

(52) U.S. Cl. ..... 72/328; 72/336; 72/339; 72/405.07

(58) Field of Search ..... 72/339, 338, 337, 72/328, 330, 331, 405.07, 421, 335, 336

(56) References Cited

U.S. PATENT DOCUMENTS 3,368,383 A * 2/1968 Marszal ..... 29/421
3,650,141 A * 3/1972 Pepe ..... 72/332
3,774,435 A * 11/1973 Wales ..... 72/331
4,360,959 A * 11/1982 Johannesen ..... 72/338
4,688,415 A * 8/1987 Pendelton ..... 72/335
5,182,933 A * 2/1993 Schick ..... 72/335
5,247,825 A * 9/1993 Erickson ..... 72/339
5,791,186 A * 8/1998 Nishida ..... 72/339

* cited by examiner

*Primary Examiner*—Daniel C. Crane
(74) *Attorney, Agent, or Firm*—Alex Rhodes

(57) ABSTRACT

A carrierless progressive die system and method for improving part quality and reducing cost. A strip of sheet material advances between a plurality of die stations along a continuous planar surface of a die lifter and stripper pad combination formed or assembled as a single piece. The width of the sheet material is substantially the same as the width of a finished part and its outer edge portions are maintained structurally rigid during operations at the various die operations by providing centrally positioned lances between die stations and holes at the distal ends of the lances which prevent propagation of the lances during stretching and forming of the sheet material.

21 Claims, 3 Drawing Sheets

CARRIERLESS PROGRESSIVE DIE SYSTEM

This application claims benefit of No. 60/150,648, filed Aug. 25, 1999.

FIELD OF THE INVENTION

This invention generally relates to the progressive die stamping art and, more particularly, to a method and apparatus for producing stamped parts which are formed utilizing a progressive die wherein carrier ribbons are not required to provide support for the stamped part as it progresses through the progressive die stamping process.

BACKGROUND OF THE INVENTION

Progressive dies are among the most common type of multiple operation dies currently used in the metal stamping industry. As the name implies, a sequence of different punching, drawing, cutting, or other forming operations are performed on a continuous sheet of metal as the sheet progresses through the sequence of dies. The various operations progressively alter the original flat sheet of material until a finished part is formed and is typically separated from the sheet material by a final cut off die. Current progressive die systems generally utilize a carrier strip, carrier ribbon, or strip skeleton typically along each edge of the metal sheet to provide a structural bridge between the parts as the parts are progressively formed along the sequence of dies. The carrier ribbon is typically located along each edge of the metal sheet and is outside of the finish product area. Often, progressive die systems have encountered difficulties in achieving proper part alignment due to flexing of the material, or encounter low feed rates when utilizing a conventional carrier ribbon because the carrier ribbon is relatively fragile, particularly with light metal parts.

In an effort to overcome this difficulty, a common solution has been to increase the width of the carrier ribbons to provide a more intrinsic rigidity as the sheet presses through the progressive dies. One significant disadvantage of this approach is the increased scrap metal produced as a result of requiring the wider stock material. This disadvantage increases the cost of producing parts not only because of the increased material which must be purchased, but also because of the increased handling to remove the excess material, and if some costs are hoped to be recouped, the cost of recycling the scrap material.

Efforts have also been made to increase the rigidity of the carrier ribbons by forming a strengthening bead or rib along the edges of the sheet at an early station within the progressive die system. While incorporating the strengthening means may improve the stability of the carrier ribbon, this method simply allows for a slight reduction, if any, in the amount of scrap produced.

Currently, if a manufacturer wishes to produce a part which does not include providing the extra width required for the carrier ribbons, single action presses have been employed whereby each operation is performed with a separate die stationed on a separate press. Parts are then transferred from press to press with the operations being performed on each individual part. This approach generally involves significant labor costs and has a greater likelihood of increasing scrap rates due to misalignment of the parts within any one of the multiple dies in which the part must be oriented.

In light of the above disadvantages with the single action approach, the progressive die systems provide the advantage that there is no need to inspect the parts between operations, there is a considerable increase in safety to the operators, and only one press is needed instead of multiple presses thereby resulting in better machine utilization, less floor space, reduced die set up time and labor, and less fixed overhead costs.

With the significant advantages of utilizing a progressive die system, there is a need within the industry to provide a progressive die system which incorporates the advantages of the single action approach, specifically the elimination of any carrier ribbon required to transfer the part from station to station of the progressive die.

SUMMARY OF THE INVENTION

In accordance with the teachings of the present invention, there is provided a progressive die system allowing for a carrierless part formation and transfer from station to station as a formed part advances through a sequence of forming and/or cutting dies while maintaining structural integrity and alignment during the station to station progression.

BRIEF DESCRIPTION OF THE DRAWINGS

The various advantages of the present invention will become apparent to one skilled in the art upon reading the following specification and by reference to the drawings in which.

DETAILED DESCRIPTION OF THE PREFERRED EMBODIMENTS

Figure 1:
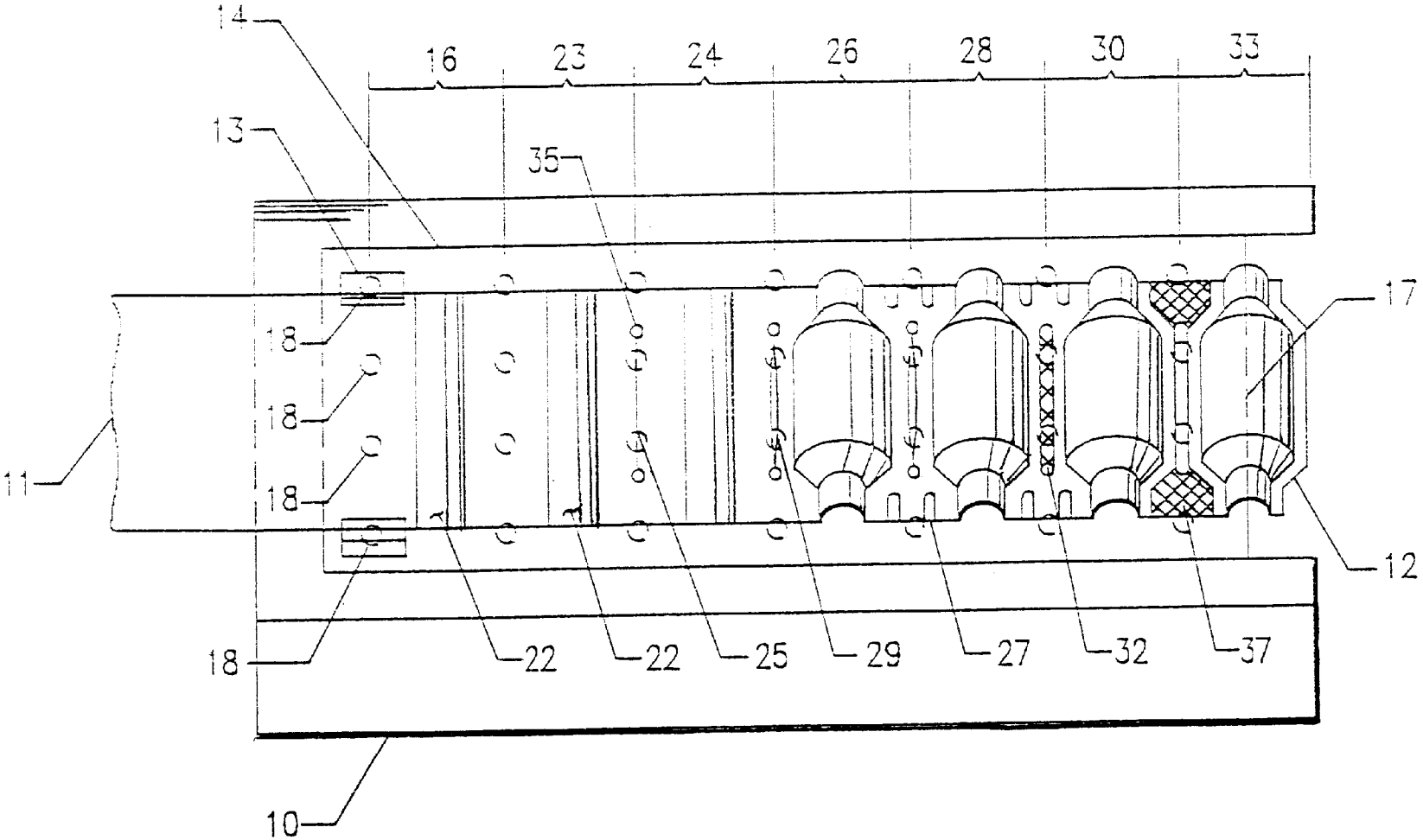
FIG. 1 is a perspective view of a strip of sheet metal and representative lower half of a seven station stretch forming progressive die made in accordance with the teachings of the present invention, the upper half of the die being conventional.
Figure 2:
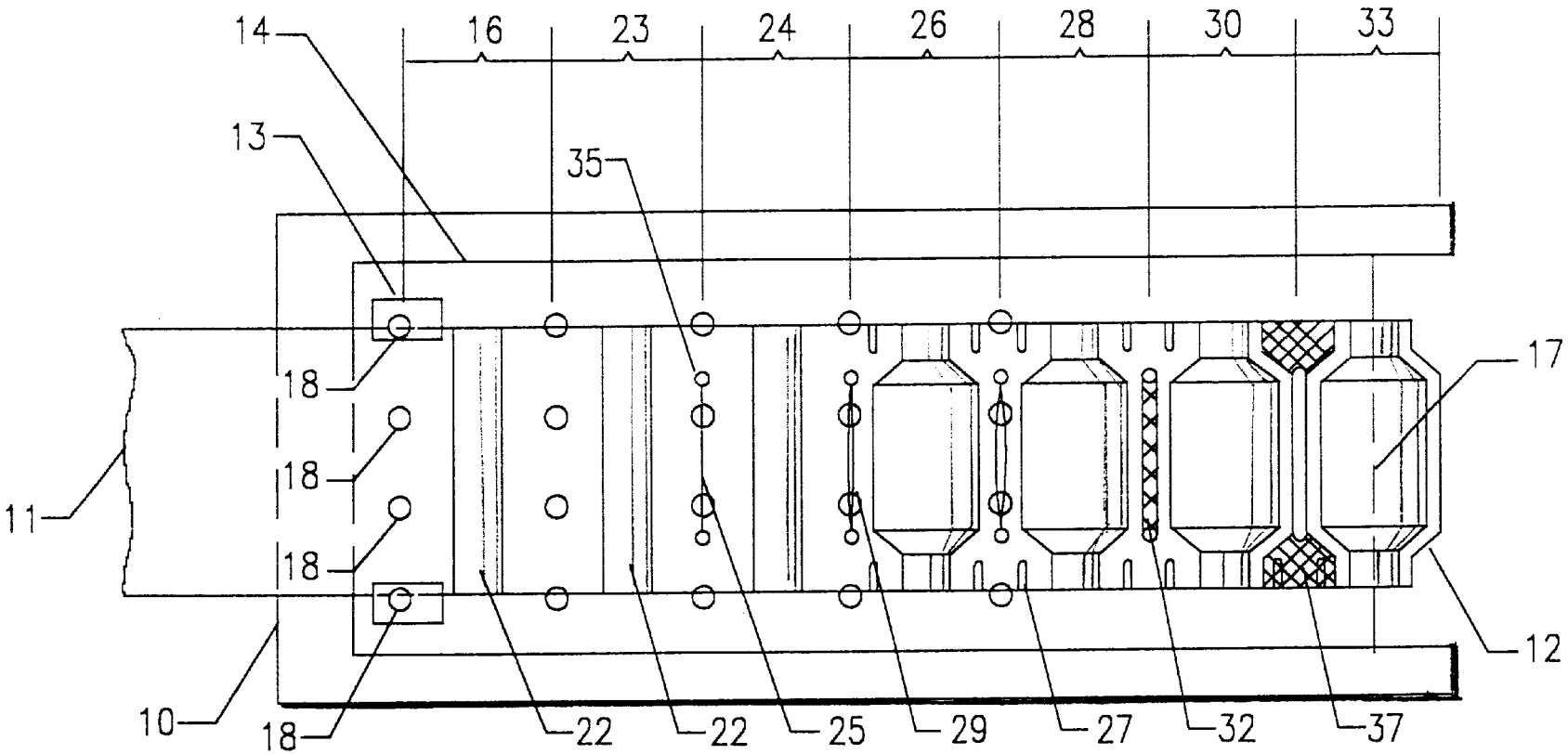
FIG. 2 is a plan view of the sheet material and lower half of the progressive die shown in FIG. 1.
Figure 3:
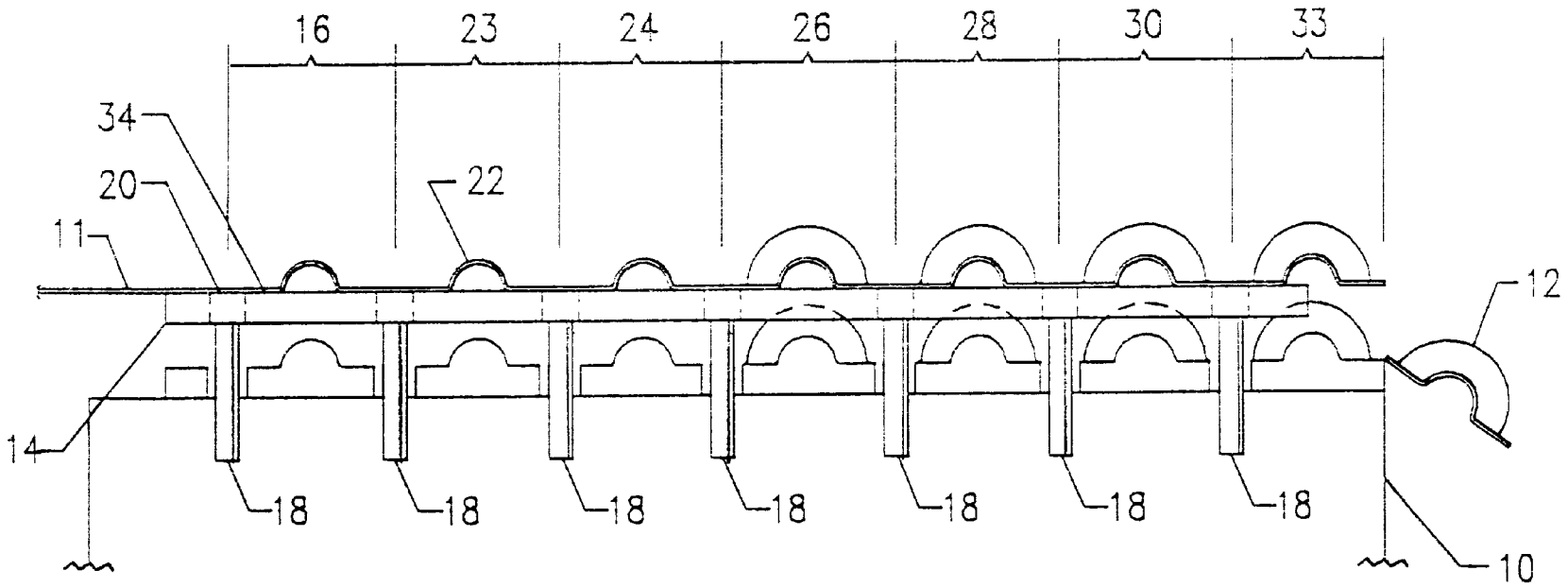
FIG. 3 is a side view of the lower half of the progressive die shown in FIG. 1 with a die lifter and stripper pad in an elevated position in accordance with the teachings of the present invention.

The following descriptions of the preferred embodiments are merely exemplary in nature and are in no way intended to limit the invention, or its application or uses.

With reference to the figures, a strip of sheet material 11 and a lower half 10 of a seven station progressive die system is shown and, is incorporated in a conventional stamping press as is known in the art. The sheet material 11 progresses from the left side of the figures toward the right side of the figures throughout the description herein. The sheet material 11 is typically provided from a continuous roll of material which is straightened and fed to the progressive die system of the present invention. Alternately, one skilled in the art will readily recognize that flat stock material which is precut to discrete lengths can also be fed into the progressive die system of the present invention in place of the coiled stock of material. The sheet material 11 can be a wide variety of metals such as steel, or any other similarly formable material whether metal or nonmetal in composition.

The sheet material 11 used in conjunction with the present invention has a width $W_M$ which is substantially the same as the width Wp of the finished product 12. The product 12 being formed within the present example is a catalytic converter half shell 12, however, the present invention can be applied equally to any part formed utilizing a progressive die system.

At the leading portion of station one is a traveling coil guide 13 attached to a die lifter and stripper pad 14 which are preferably formed or assembled as a single piece. The terms "traveling coil guide" is intended to embrace other well known means for guiding a strip of sheet material through a progressive die such as stock rails, angles, buttons and pins, whether spring biased or fixed. Effectively, this single piece lifter and stripper pad 14 construction, extending from station one 16 substantially to the midpoint 17 of station seven 24, provides a generally planar continuous surface 34 for the sheet material 11 to pass over as the material 11 progresses from station one 16 through station seven 24 in the present example.

The one piece die lifter and stripper pad 14 just described allows the material 11 to progress along the continuous surface 34 by means of a conventional coil feeder (not shown) and to lift the progressively formed parts of the sheet material 11 to a common datum line 20 actuated by a plurality of pressure pins 18 or self-contained nitrogen cylinders. The coil feeder can be any one of the numerous types of suitable material feeders known in the art, including roll feeders, hitch feeders, grip feeders and slide feeders. Utilizing the one piece die pad 14 eliminates the need for external lifters traditionally used with carrier ribbons to raise a formed part above a lower die thereby allowing the part sheet material 11 to advance.

Station one 16 of the present example provides an optional preform channel 22 which effectively forms the major cylindrical shape of the final part 12 without substantially stretching the material. This preform channel 22 provides sufficient material thickness for the final forming stages described below. Station two 23 in the present example is an idle station wherein no forming or operation is performed on the sheet material 11. This idle station is provided because the operation performed in station three 24 is performed at the leading edge of station three 24 (over the trailing edge of station two). At station three 24 of the present example, the sheet material 11 is lanced 25 substantially parallel to the width of the material Wm. The lance 25 is substantially centrally located in this example because of the symmetry of the part 12 being produced and does not extend to the outer edges of the sheet material 11. At each distal end of the lance 25, a hole 35 is preferably pierced which not only acts as an internal pilot should one be desired, but also acts as a stress relief feature and effectively stops any splitting of the sheet material 11 which may be caused by the lance 25 trying to propagate to the edges of the sheet material 11 during subsequent forming stations.

Station four 26 of the present example is a stretch forming station wherein the part 12 is stretched to a "home" position by the stretch form die 26. As shown, the formation extends to the edge of the sheet material 11 and provides an open end substantially defining the ends of the final product. Beading formations 27 can be incorporated in station four 26 in order to control distortions in the sheet material 11 which may be caused by excess material during the stretch forming operations.

Station five 28 of the present example is a re-draw or re-strike station as is commonly used in conventional progressive die systems. During the re-strike a greater gaping 29 may be produced along the lanced portion 25 of the sheet material 11 to accommodate changes in the sheet material 11 as it is formed. Again, note that the holes 35, or split stoppers, act as a stress relief feature such that should the material stresses at the end of the lance 25 be sufficient to tear the sheet material 11, the tear will not propagate beyond the previously pierced holes 35. At the leading edge of station six 30 in the present example is a trimming operation wherein cross-hatched material 32 surrounding the lanced portion 25 of the sheet material 11 is removed thereby providing a finished trim for the central portion between the pilot holes of the finished part 12.

Station seven 33 of the present example is a further finished trim or cut off and size station which removes the cross-hatched material not previously removed in station six 30 and, if necessary, to ensure dimensional accuracy of the width Wp of the part 12 provides a clean cut along the edges of the width Wp thereby removing any variation which may occur because of the stretching of the sheet material 11 during the previous stamping operations. This final cut off station 33 also completely severs the finished part 12 from the progressively fed sheet material 11 and ejects the part 12 into a container or onto a conveying system depending upon the subsequent operations for the converter half shell formed in the present example.

As seen from the above description, by providing lances 25 and holes located near the distal ends of the lances 25 of the sheet material 11, structurally rigid outer edges are provided so that the sheet material 11 can be advanced simply by the coil or sheet feeder system located prior to station one 16. The holes 35 of the present invention also provide a stress relief which will stop any propagation of the lances 25 portion of the sheet material 11 thereby insuring the integrity of the outer edges of the sheet material 11. In light of the structural integrity of the sheet material 11, when combined with the single continuous plane 34 which the die lifter and stripper pad combination 14 provides, the sheet material 11 can be quickly and reliably advanced from station to station with little or no part misalignment which would degrade part quality and likely damage the dies used in conjunction with the present invention.

The foregoing discussion discloses and describes a preferred embodiment of the present invention. One skilled in the art will readily recognize from such discussion, and from the accompanying drawings and claims, that various changes, modifications, and variations can be made therein without departing from the true spirit and fair scope of the invention as defined in the following claims.

What I claim is new is:

1. A carrierless progressive die apparatus for improving quality and reducing material costs, said carrierless progressive die apparatus comprising: a plurality of die stations for performing operations on a strip of material having a width which is substantially the same as a width of a finished part made in said die apparatus, a substantially continuous die lifter and stripper pad combination extending from a first to a last of said plurality of die stations, said die lifter and stripper pad combination forming a flat continuous surface for transporting said strip of material through said plurality of stations; a means attached to said die lifter and stripper pad combination for guiding said strip of material through said progressive die apparatus; and a means for feeding said strip of material through said plurality of stations.

2. The progressive die apparatus recited in claim 1 wherein said die lifter and pressure pad are formed as a single piece.

3. The progressive die apparatus recited in claim 1 wherein said die lifter and pressure pad are assembled as a single piece.

4. The progressive die apparatus recited in claim 1 wherein said plurality of stations includes at least one forming station.

5. The progressive die apparatus recited in claim 4 wherein said forming station is a stretch forming station.

6. The progressive die apparatus recited in claim 1 wherein said plurality of stations includes at least one trimming station.

7. The progressive die apparatus recited in claim 1 wherein said plurality of stations includes at least one idle station.

8. The progressive die apparatus recited in claim 1 wherein said plurality of stations includes a cutting station for severing said finished part from said strip of material.

9. The progressive die apparatus recited in claim 1 wherein said progressive die includes pressure pins for lifting said strip of material.

10. The progressive die apparatus recited in claim 1 wherein said plurality of stations includes nitrogen cylinders for lifting said strip of material.

11. The progressive die apparatus recited in claim 1 wherein said plurality of stations includes a station for lancing a central portion of said strip of material in a direction which is substantially parallel to a width of said strip of material.

12. The progressive die apparatus recited in claim 11 wherein said lancing station includes a means for stamping a pair of apertures at opposite ends of said lance.

13. A progressive die apparatus for improving quality and reducing material costs by eliminating carrier strips, said progressive die apparatus comprising: a plurality of die stations for performing operations on a strip of material having a width which is substantially the same as a finished part, a substantially continuous die lifter and stripper pad combination extending through said plurality of die stations, said die lifter and stripper pad combination forming a flat continuous surface for transporting said strip of material through said plurality of stations a means for locating said strip of material in said die apparatus; and a means for feeding said strip of material through said plurality of die stations.

14. A progressive die apparatus for improving quality and reducing material costs by eliminating carrier strips, said progressive die apparatus comprising: a plurality of die stations; a substantially continuous die lifter and stripper pad combination extending through said plurality of die stations, said die lifter and stripper pad combination forming a flat continuous surface for transporting a strip of material through said plurality of stations; and a means for locating a strip of material in said plurality of die stations having a width which is substantially the same as a finished part.

15. A progressive die apparatus for improving quality and reducing material costs by eliminating carrier strips, said progressive die apparatus comprising: a plurality of die stations; a substantially continuous die lifter and stripper pad combination extending through a plurality of die stations, said die lifter and stripper pad combination forming a flat continuous surface for transporting a strip of material through said plurality of stations having a width which is substantially the same as a finished part.

16. The progressive die apparatus recited in claim 15 further comprising a means in said die stations for relieving stress in said strip of material.

17. A progressive die apparatus for improving quality and reducing material costs by eliminating carrier strips, said progressive die apparatus comprising a plurality of die stations, said die stations including a stretch forming station; a means for providing a flat continuous surface for transporting a strip of material having a width which is substantially the same as a width of a finished part through said plurality of die stations; a means in said die stations for relieving stress in said strip of material in said stretch forming station; and a means for feeding said strip of material through said plurality of die stations without a strip carrier.

18. A method for improving quality and reducing the cost of stamping a finished part in a progressive die comprising the steps of; feeding and guiding a strip of material without carrier strips; said strip having a width which is substantially the same as a width of said finished part into a first station of a plurality of die stations; performing a stretch forming stamping operation on said strip of material in said plurality of die stations; raising said strip of material with a one piece die lifter and stripper pad to a common datum line; advancing said strip along a flat continuous planar surface; reducing stress in said strip by lancing a central portion of said strip of material in a direction which is parallel to a width of said strip; performing at least one additional stamping operation on said strip; raising and advancing said strip of material on said flat continuous planar surface; and separating and ejecting said finished part from said strip of material.

19. The method recited in claim 18 further comprising the step of providing internal pilots and stress relief at opposite ends of said lanced portion by stamping a pair of spaced apart holes at opposite ends of said lanced portion of said strip of material.

20. The method recited in claim 18 further comprising the step of controlling distortion in said strip of material by stamping beads in opposite edge portions of said strip of material.

21. The method recited in claim 18 further comprising the step of trimming excess material from said strip of material.

* * * * *